United States Patent [19]

Brema et al.

[11] Patent Number: 4,498,660

[45] Date of Patent: Feb. 12, 1985

[54] MODULAR FENCE STRUCTURE

[75] Inventors: Robert J. Brema, Thornhill; Gerald J. Adamson; Philip L. Poissant, both of Toronto; John H. Cleminson, Orangeville, all of Canada

[73] Assignee: Union Carbide Canada Limited, Toronto, Canada

[21] Appl. No.: 555,766

[22] Filed: Nov. 28, 1983

[30] Foreign Application Priority Data

Dec. 2, 1982 [CA] Canada ..... 416843

[51] Int. Cl.[3] ..... E04H 17/14

[52] U.S. Cl. ..... 256/19; 256/13.1; 256/66; 256/12.5; 52/473

[58] Field of Search ..... 256/66, 65, 72, 19, 256/24, 13.1, 12.5; 52/473

[56] References Cited

U.S. PATENT DOCUMENTS 2,906,506 9/1959 Barnes et al. ..... 256/19
3,238,683 3/1966 Maxwell ..... 52/473
3,537,687 11/1970 Adelman ..... 256/19
4,145,031 3/1979 Baker ..... 256/65
4,174,096 11/1979 Campbell ..... 256/65 X

FOREIGN PATENT DOCUMENTS 782754 9/1957 United Kingdom ..... 52/473

*Primary Examiner*—Andrew V. Kundrat
*Attorney, Agent, or Firm*—James C. Arvantes; William G. Hopley; Albert E. Koller

[57] ABSTRACT

A fence structure is described consisting of modular panels mounted on posts. The modular panels are of thermoplastic or thermoset material having a rail portion and a connector at each end for fitting over the posts. The connector has an integral expansion joint in its central passage and each connector is offset in opposite directions to the longitudinal center of the panel to provide a hinged effect with the connectors of adjacent panels in the fence. The construction is readily adaptable to sloping ground and variation in height between panels and provides simplified installation by easy alignment.

3 Claims, 7 Drawing Figures

MODULAR FENCE STRUCTURE

FIELD OF THE INVENTION

This invention relates to a modular fence structure, more particularly it relates to a fence construction of interconnecting modular elements including structural foam panels of thermoplastic or thermosetting material which can be easily constructed without securing fasteners between each post and panel section.

DESCRIPTION OF THE PRIOR ART

Various attempts have been made in the past to construct a fence that would be simple to assemble, relatively inexpensive and maintenance free. Such fences were designed for long term assembly for marking off property boundaries or for temporary assembly as snow fences or crowd control barriers. Fences that were designed for long term assembly such as woven aluminum or steel fences such as described in Canadian Pat. No. 988762 require the intricate fitting together of metal parts and fasteners to maintain the fence sections under tension. Such intricate assembly would not be practical in constructing a fence for temporary use. U.S. Pat. No. 4,145,031 provides a modular fence with interlocking elements but does not provide for a variation in fence design nor does it permit angling of the fence about the connector due to the linear construction of the rails.

SUMMARY OF THE INVENTION

The present invention however provides a fence which can be easily assembled without connecting fasteners such as bolts, screws or hardware of any kind and can be varied as to height and surface design and can withstand contraction or expansion due to seasonal changes. The unique design of the rail panels permits the panels to be assembled in a louvered up or louvered down position depending on whether or not one wants free flow of air through the fence and whether or not one wants to block out the view or block out air and provide complete privacy.

It is therefore an object of the invention to provide a modular fence that is easy to assemble and can be varied on construction to any preferred height as a multiple of the individual panel height and to accommodate changing slopes.

It is another object of this invention to provide a modular fence that is highly resistant to corrosion, mildew, rot and impact.

It is still another object of this invention to provide a modular fence that permits versatility with respect to surface design and air and light control.

These and other objects are provided by means of a modular fence comprising a first, a second and a third post aligned vertically parallel and having at least one modular panel mounted between each of said posts; each said modular panel comprising a rail section, a first connector member at one end of said rail section and a second connector member at the opposite end of said rail section, each of said connector members positioned offset from the longitudinal axis of said panel on opposite sides of said axis from each other and having a central passage for passing a length of one of said posts therethrough and including an expansion joint within said central passage for gripping said post; such modular panels being so mounted on said posts that the first connector member of the modular panel between the second and third post is positioned below the second connector member of the modular panel mounted between the first and second posts to provide an interconnecting of said modular panels.

DETAILED DESCRIPTION OF THE INVENTION

Figure 1:
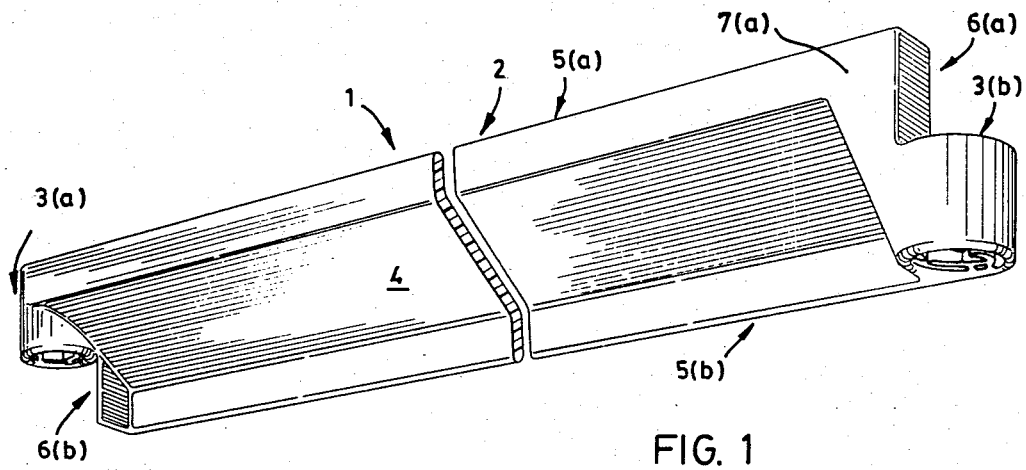
FIG. 1 is a perspective view of a modular panel of this invention in broken away construction for purposes of illustration.

FIG. 1 shows a modular panel 1 of this invention consisting of the rail 2 and integral end connectors 3(*a*) and 3(*b*). Rail 2 consists of a louver portion 4 angled at approximately 45° and lip portions 5(*a*) and 5(*b*). It must be appreciated that there can be considerable variation in the degree of angling of louver portion 4 but lip portions 5(*a*) and 5(*b*) should be substantially parallel to each other to provide integral construction when the modular panels are stacked in an assembled fence. It can be noted that in upright fence assembly the lip portions would be perpendicular to the ground. Connectors are positioned at each end of rail 2 but at opposite corners so that one end of connector 3(*a*) is integral with the edge of lip portion 5(*a*) and similarly one end of connector 3(*b*) is integral with the ends of lip portion 5(*b*). It must be appreciated that while the embodiment shown in the drawings has the connectors and rail portion moulded as an integral unit, the connectors can be moulded separately and joined to the central panel by bonding or other means. It can be noted that each of the lip portions extend to form an end abutment 6(*a*) and 6(*b*) to fit against a spacer or adjoining modular panel as will be described below. The lip portions also extend to form a reinforcing edge 7(*a*) and 7(*b*) respectively to provide strength and durability to the panel.

The modular panels are preferably made of thermoplastic material such as polypropylene, polyvinyl chloride, high density polyethylene, polystyrene or acrylonitrile-butadiene-styrene polymer or of thermoset material such as polyurethane, polyesters, or phenolics. Such material can be extruded or moulded in a manner well known in the art and may also be modified to include gases and/or fibrous and particulate fillers.

Figure 2:
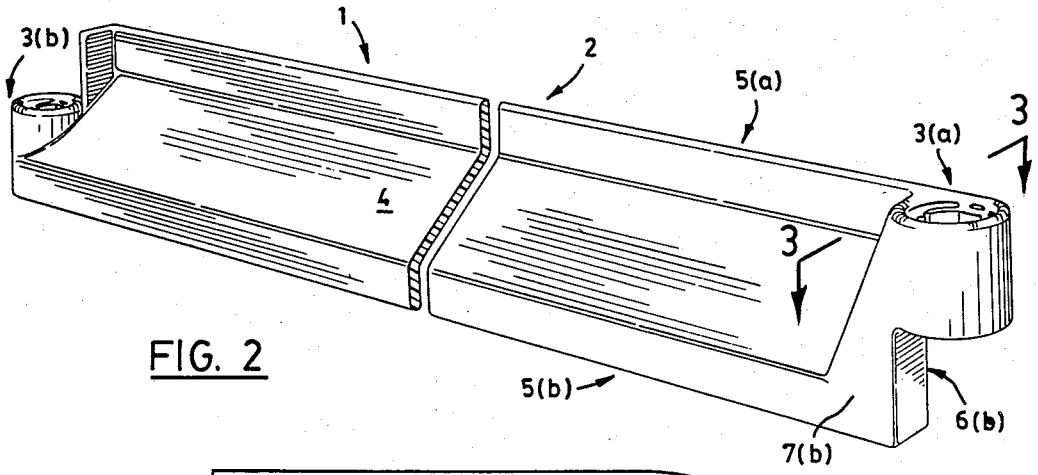
FIG. 2 is a perspective view of the modular panel when rotated about the perpendicular axis with respect to the illustration in FIG. 1.

FIG. 2 shows the same modular panel 1 turned around so that the connector shown on the left of rail 2 in FIG. 1 is now shown on the right. In this position louvered portion 4 is angled in the opposite direction and lip portion 5(*b*) is now in front. If panel 1 in FIG. 1 were to have been rotated about the planar axis, lip portion 5(*b*) would still be in front but now at the lower end of the panel. The significance of the overall design of the panel and the positioning of the connectors will be appreciated when the various embodiments of the fence assembly are described with respect to drawings 4–7.

Figure 3:
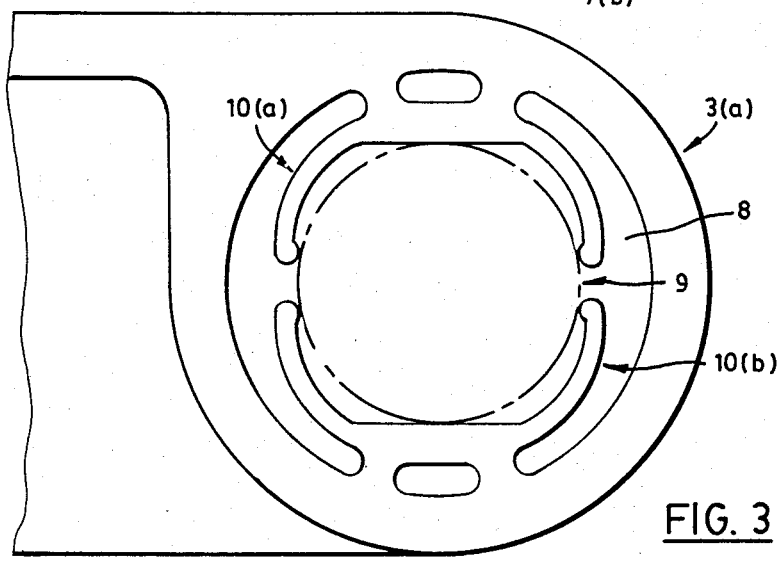
FIG. 3 is a plane elevation of the integral end connector and expansion joint on the rail panel of FIG. 2.

FIG. 3 shows details of the central passage through integral connector 3(*a*) of FIG. 2. The connector has a central passage 8. The broken circumferential line 9 illustrates the cross section of a fence post which passes through passage 8 when the modular panel is mounted in place. On each side of the central passage 8 is an expansion joint 10(*a*) and 10(*b*) respectively. When the panel is mounted in place by sliding the connectors 3 over a fence post, the expansion joints which are moulded within the central passage of the connector and integral therewith grip the post in the manner illustrated in FIG. 3. These expansion joints permit linear expansion or contraction in the modular panel which might occur due to temperature changes and physical stress.

Figure 4:
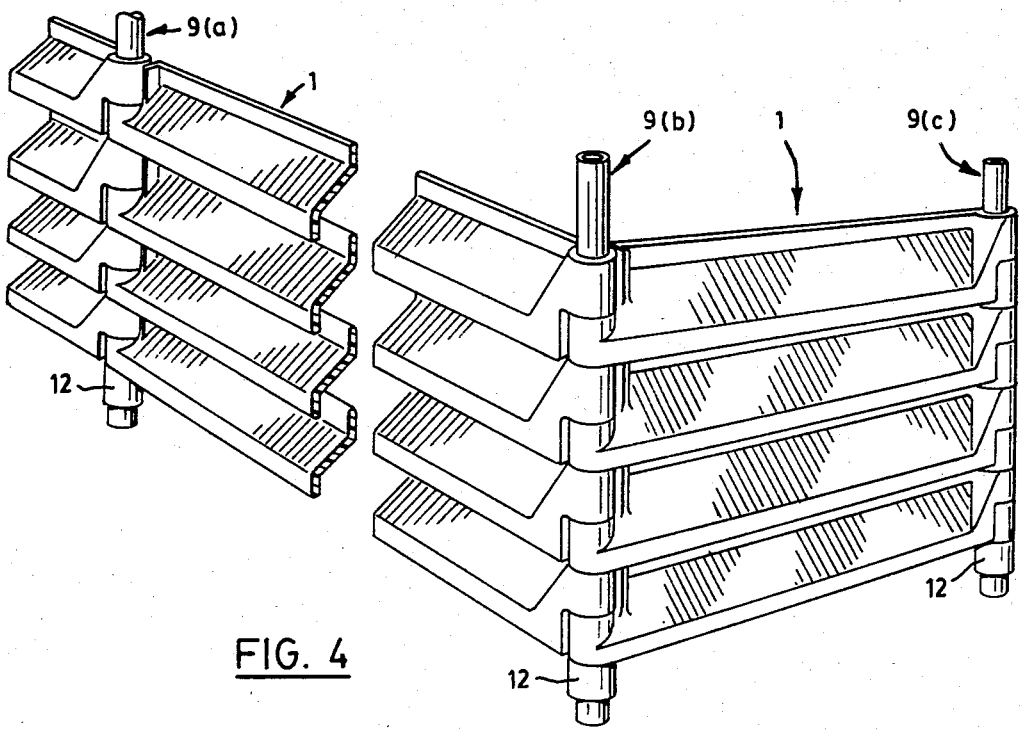
FIG. 4 is a perspective view of a fence assembly showing a series of mounted modular panels in broken away construction for purposes of illustration.

FIG. 4 illustrates a fence assembly with modular panels 1 mounted on fence posts 9(*a*) (*b*) and (*c*). In the embodiment shown in FIG. 4, the panels are all mounted in the manner shown in FIG. 2 with the louvered portion 4 of the rail sloping downward towards the exterior of the fence. The drawing shows the panels on one section of fence in break-away illustration so that the sloping of the louvers and positioning of the louvers and lip portions of one rail with respect to an adjacent rail can be clearly seen. It can also be noted that the fence is angled at post 9(*b*) to provide for horizontal direction changes and the degree of angling can be varied. With the present design the fence can be angled without modifying the uniformity of the panels.

Figure 5:
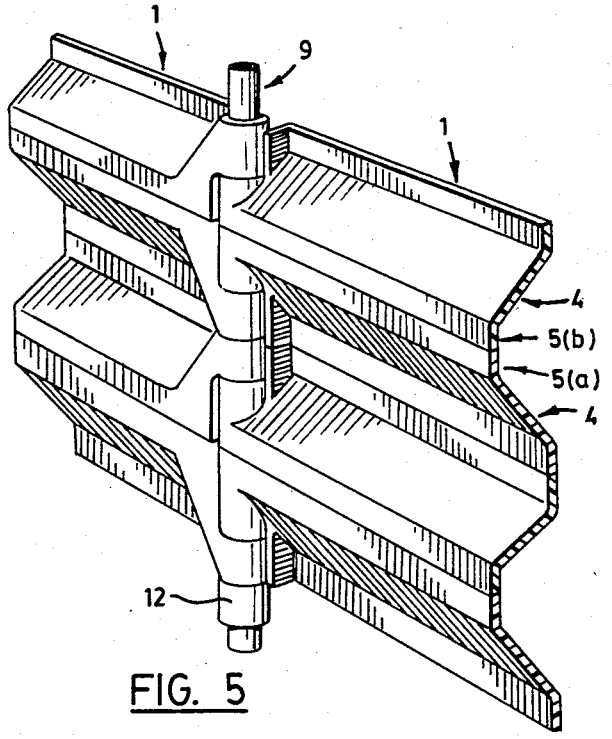
FIG. 5 is a perspective view in partial illustration of another embodiment of the fence assembly showing the mounted modular panels in broken construction for purposes of illustration.

FIG. 5 illustrates another embodiment of a fence assembly wherein the modular panels are positioned alternatively to give a slightly different design. In this embodiment the bottom panel is mounted in the manner shown in FIG. 1 and the panel immediately above is mounted as shown in FIG. 2. The louvers are angled outwardly and inwardly and the lip portions of adjacent panels abut. Unlike the embodiment of FIG. 4 wherein the fence assembly blocks out a horizontal view through the fence but permits air to circulate freely between the panels, the embodiment of FIG. 5 effectively blocks out the air circulation as well as the view.

Figure 6:
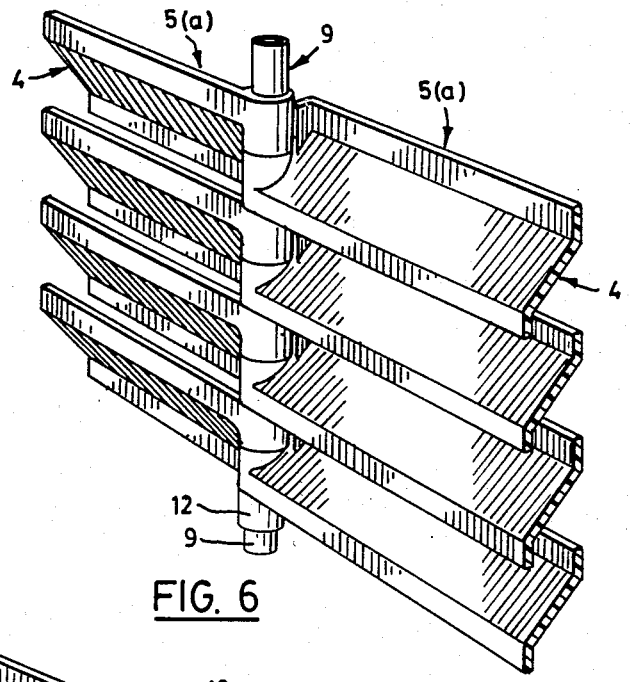
FIG. 6 is a perspective view in partial illustration of yet another embodiment of the fence assembly showing the mounted modular panels in broken construction for purposes of illustration.

FIG. 6 illustrates still another embodiment wherein the modular panels are all stacked in the same position on one fence section but are stacked in another position on the adjacent fence post. Thus the panels to the right of fence post 9 are stacked in the position shown in FIG. 2., the panels to the left of fence post 9 are stacked in the manner that can best be visualized when the panel in FIG. 2 was rotated about an axis perpendicular to the plane of the drawing. This embodiment provides alternative upward and downward air currents through the fence.

Figure 7:
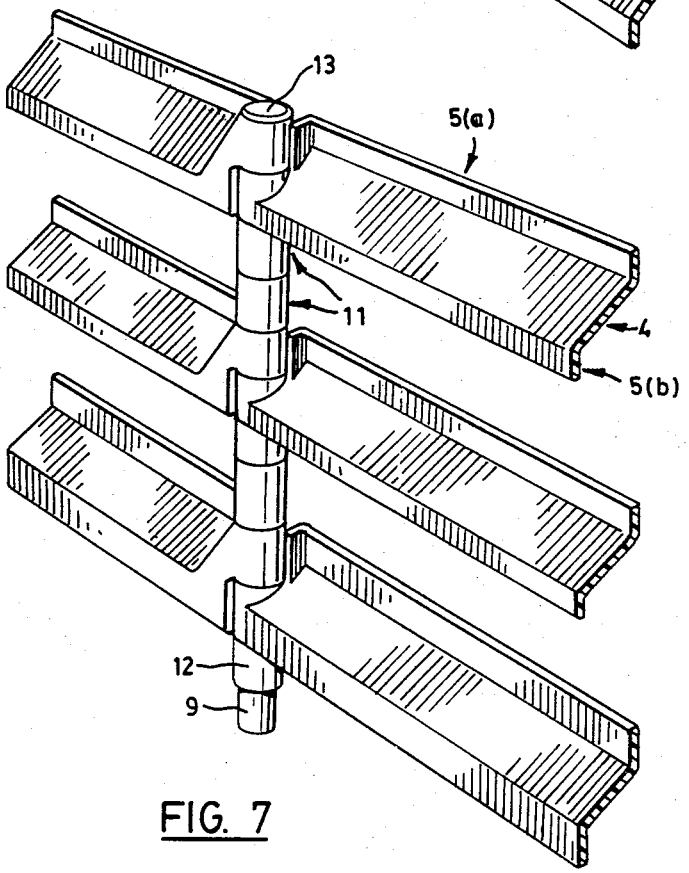
FIG. 7 is a perspective view in partial illustration of still another embodiment of the fence assembly showing the mounted modular panels in broken construction for purposes of illustration.

FIG. 7 shows still another embodiment wherein cylindrical spacers 11 are used between the panels to provide a view as well as greater air space through the fence. Cylindrical spacers 11 can be of the same material as the modular panels. They can be of various lengths depending on the distance desired between panels or as shown in FIG. 7, two or more can be mounted in series. The spacers must have a central passage for receiving the fence post. It is not necessary however that their central passages include expansion joints. However if one wishes to support a panel high above the lower panel for greater spacing or for levelling above the ground in the case of uneven terrain a locking spacer can be used. In FIG. 7 all of the panels on both sides of the post are mounted as shown in FIG. 2.

A modular fence can be easily assembled using fence posts supported on a free standing base if the purpose is to erect a temporary fence such as used for crowd control or as a traffic barrier. If a relatively permanent fence is required the post can be secured in the ground. Another advantage in the modular fence structure of this invention is the ease in which a permanent fence can be assembled.

With conventional fencing the fence posts have to be set apart by accurate measurements and secured into position before the panels are fitted in place. With the modular fence of this invention the first post must be secured in place and the holes for the other posts set out in rough approximation. A modular panel is fitted in place by sliding one of its connectors over the first post and the outer connector over a second post which need not be firmly secured in the ground. This panel is moved all the way down to form the bottom of the fence. It must be appreciated that a cylindrical securing spacer 12 can be positioned at the bottom of the posts if some separation between the bottom panel and the ground is required. A second panel is fitted in place by sliding one of its connectors over the second post and the other of its connectors over a third post. This second panel is moved all the way down to continue the bottom of the fence. If the fence is to be extended further, the next panel must be fitted between the third and next post so that the bottom of the fence must be complete before the second layer of panels are placed in position. Again the second layer must be completed along the fence before the third layer is mounted. When the desired height is reached, the builder then brings all the posts into alignment by pulling on the post which is farthest from the first secured post but still linear to it. This brings the second, third and additional posts in alignment where they may be permanently secured. When the fence includes one or more corners such as in building an enclosure, the corner post must be secured before a horizontal directional change in the fence is continued with subsequent posts and panels.

When all the panels and spacers are in position so that the fence is at its desired height, the upper ends of the fence posts can be finished off by means of a closure cap 13 or by expanding the ends of the posts to prevent the panels from being easily removed if the fence is to stand for a long period of time.

It should be noted that the panels of the present invention are so designed that a wide latitude of pivoting is permitted about a post to provide angling or cornering of the fence. In the embodiment shown in the drawings for example, an overall arc of 220 degrees of pivoting of a panel in relation to its adjacent panel can be achieved.

The embodiments of the invention in which an exclusive property or privilege is claimed are defined as follows:

1. A fence comprising a first, a second and a third post aligned in parallel and having at least two modular panels mounted between each of said posts; each said modular panel comprising a rail section, a first connector member at one end of said rail section and a second connector member at the opposite end of said rail section, each of said connector members positioned offset from the longitudinal axis of said panel on opposite sides of said axis from each other and having a central passage for passing a length of one of said posts therethrough and including an expansion joint within said central passage for gripping said post; said rail section including a central louvered portion angled with respect to the connector members and a lip portion extending along the end of said louvered portion; said modular panels being so mounted on said posts that the central louvered portion of one modular panel is angled in opposite direction to the louvered portion of the adjacent modular panel so that a lip portion of one panel abuts the lip portion of the adjacent panel and the first connector member of the modular panel between the second and third post is positioned below the second connector member of the modular panel mounted between the first and second posts to provide an interconnecting of said modular panels.

2. A fence as claimed in claim 1 wherein said modular panel is of thermoplastic material selected from the group consisting of polypropylene, polyvinyl chloride, high-density polyethylene, polystyrene and acrylonitrile-butadiene-styrene polymer.

3. A fence as claimed in claim 1 wherein said modular panel is of thermoset material selected from the group consisting of polyurethane, polyesters and phenolics.

* * * * *